United States Patent [19]

Theurer

[11] 4,249,325

[45] Feb. 10, 1981

[54] TRACK WORKING MACHINE FOR DISTRIBUTING AND SHAPING THE BALLAST OF A RAILROAD BED

[75] Inventor: Josef Theurer, Vienna, Austria

[73] Assignee: Franz Plasser Bahnbaumaschinen-Industriegesellschaft m.b.H., Vienna, Austria

[21] Appl. No.: 93,048

[22] Filed: Nov. 13, 1979

[30] Foreign Application Priority Data

Feb. 2, 1979 [AT] Austria ..... 806/79

[51] Int. Cl.[3] ..... E01B 27/04

[52] U.S. Cl. ..... 37/104; 104/2

[58] Field of Search ..... 104/2; 37/104, 105, 37/106, 107, 22–33; 172/666–668, 782

[56] References Cited

U.S. PATENT DOCUMENTS 3,605,297 9/1971 Kershaw ..... 37/105

3,877,160 4/1975 Plasser et al. ..... 37/104

FOREIGN PATENT DOCUMENTS 1248082 8/1967 Fed. Rep. of Germany ..... 104/2

*Primary Examiner*—Richard A. Bertsch

*Attorney, Agent, or Firm*—Kurt Kelman

[57] ABSTRACT

A track working machine for distributing and shaping the ballast of a railroad bed comprises a ballast plow arrangement vertically adjustably mounted on a machine frame and including a generally V-shaped plow including a pair of plow blades and a ballast guide plate associated with each plow blade, the ballast guide plate bing adjustable in relation to the associated plow blade and a respective plow blade being associated with each track rail and bridging over the associated track rail. One drive vertically adjusts the ballast plow arrangement in relation to the frame and an additional drive mechanism vertically adjusts the ballast guide plates in relation to the plow blades.

11 Claims, 12 Drawing Figures

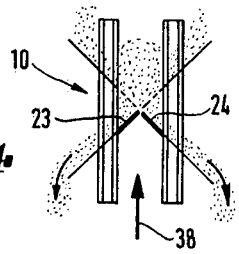
Fig. 4
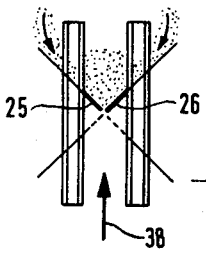
Fig. 5
Fig. 6
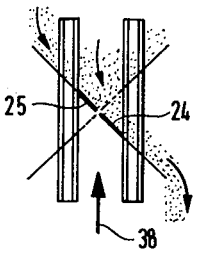
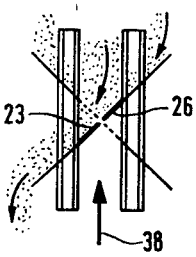
Fig. 7
Fig. 8
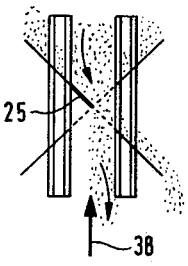
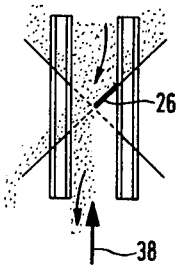
Fig. 9
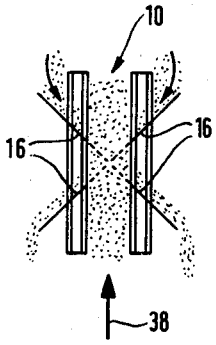
Fig. 12
Fig. 10
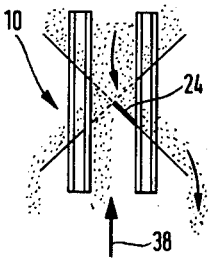
Fig. 11
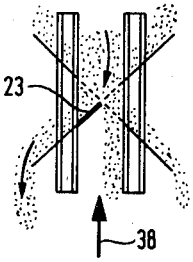

TRACK WORKING MACHINE FOR DISTRIBUTING AND SHAPING THE BALLAST OF A RAILROAD BED

The present invention relates to improvements in a track working machine for distributing and shaping the ballast of a railroad bed whereon two track rails are supported, the track rails defining a transversely extending space therebetween.

Accepted German patent application No. 1,248,082, published Aug. 24, 1967, discloses a ballast plow arrangement including a pair of plow blades, a respective one of the plow blades being associated with each track rail and bridging over the associated track rail, and a drive for independently vertically adjusting each plow blade in relation to a mobile machine frame. In use, there is no way of removing the ballast from the space between the track rails, particularly where the plow blades are alternately used in succession.

U.S. Pat. No. 3,605,297, dated Aug. 5, 1968, discloses a railroad ballast plow which may be moved on- or off-track and comprises a ballast plow arrangement including a generally V-shaped plow including a pair of plow blades, a respective one of the plow blades being associated with each track rail and bridging over the associated track rail. The plow is mounted on a carrier frame upwardly pivotally mounted at the front of the machine frame and each plow blade is comprised of two adjacent plates linked together for adjustment about a respective vertical axis. Respective ballast side-bank working tools or wings are pivotally carried at each side of the machine frame. The geometric conditions permit only two pivotal positions of the plow blades, i.e. a V-shaped working position, with the apex of the V pointing forwardly or rearwardly, and an oblique working position wherein the plow blades extend straight across the track at an angle to the track rails. This plow arrangement has a number of disadvantages. The often considerable pressure forces exerted by the ballast on the plow blades must be absorbed largely by the pivotal bearings of the plow blades and this causes a rapid wear of the bearings. While the pivotal mounting and the drives for the plow blades involve rather complex structures, the working positions of the plow are severely limited. There is, for instance, no possibility of distributing selected amounts of ballast stored in the space between the track rails to the side banks. Furthermore, at the intersection between the plow blades and the associated rails, the ballast is pushed directly over the exposed rails and rail fastening elements, which may cause serious damage thereto. More particularly, ballast may become jammed between the fixed rail fastening elements and the edges of the cut-outs in the plow blades through which the rails extend, as the plow is moved along the track. This will seriously damage the track as well as the plow.

U.S. Pat. No. 3,877,160, dated Apr. 15, 1975, discloses a mobile ballast plow arrangement including a central plow arranged in the space between the track rails and including three plow blades pivotal about a central vertical axis. Two of the plow blades may be pivotally adjusted so as to form a generally V-shaped plow and the third plow blade may be pivotally positioned so that ballast is moved from the center to the banks of the track. This machine also has conveyor means for excess ballast and a storage bin for temporarily storing such ballast so that it is very efficient in use. It has, therefore, been very successful in practice.

It is the primary object of this invention to provide a mobile ballast plow of simple and robust structure, and whose plow components may be rapidly and readily repositioned for adjustment to prevailing operating conditions.

The above and other objects are accomplished according to the invention with a track working machine comprising a frame and a ballast plow arrangement vertically adjustably mounted on the frame. The plow arrangement includes a generally V-shaped plow including a pair of plow blades, a respective plow blade associated with each track rail and bridging over the associated track rail, and a ballast guide plate associated with each plow blade in the transversely extending space between the two track rails and adjustable in relation to the associated plow blade. The machine further comprises a drive for vertically adjusting the ballast plow arrangement in relation to the frame and additional drive means for vertically adjusting the ballast guide plates in relation to the plow blades.

This very simple structural combination not only enables the ballast guide plates to be coordinated with the plow blades so as to adapt the plow to various ballast accumulations and configurations but, in addition, provides a highly space-saving construction of very robust structure. Such a track working machine fully meets all the operating and efficiency requirements encountered in a continuous ballast distributing the shaping operation involving a continuous flow of ballast. The individual adjustability of the plow components enables a selective use of the plow under rapidly changing ballast conditions.

The above and other objects, advantages and features of the present invention will become more apparent from the following detailed description of a now preferred embodiment thereof, taken in conjunction with the schematic drawing wherein:

FIGS. 4 to 12 are diagrammatic top views indicating various plow operating positions.

Figure 1:
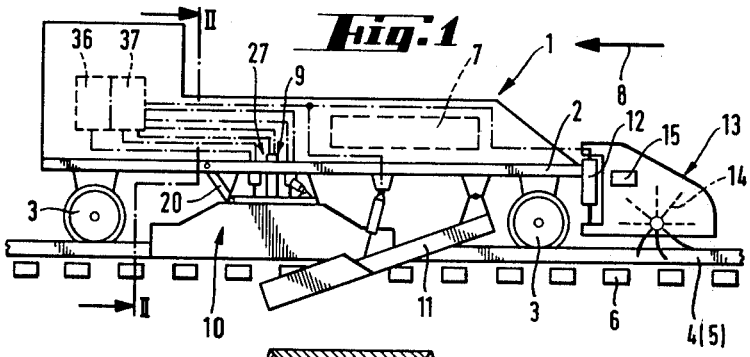
FIG. 1 is a side elevational view of a track working machine for distributing and shaping the ballast of a railroad bed, at a small scale.

Referring now to the drawing and first to FIG. 1, there is shown track working machine 1 for distributing and shaping the ballast of a railroad bed whereon two track rails 4, 5 are supported, the track rails defining a transversely extending space therebetween. The track rails are fastened to ties 6.

Track working machine 1 comprises frame 2 which may be moved on undercarriages 3, 3 along the track in an operating direction indicated by arrow 8. The machine is self-propelled, for which purpose it comprises drive 7 which may transmit power to the wheels of rear undercarriage 3. Ballast sweeping device 13 is mounted on machine frame 2 rearwardly of rear undercarriage 3, as seen in the operating direction. The ballast sweeping device is vertically adjustable on the machine frame by drives 12 and comprises rotary broom 14 which sweeps excess ballast onto a conveyor (not shown), and the conveyor moves this excess ballast to ports 15 in the ballast sweeping device housing whence the excess ballast is deposited on the banks of the track.

Ballast plow arrangement 10 is vertically adjustably mounted on frame 2 between undercarriages 3, 3, drive 9 being provided for vertically adjusting the ballast plow arrangement in relation to the frame. Laterally adjacent the ballast plow arrangement, a pair of box plows 11 are mounted on the machine frame for working the track banks, the box plows being vertically adjustable and laterally pivotal, for instance by means of hydraulic drives.

Figure 2:
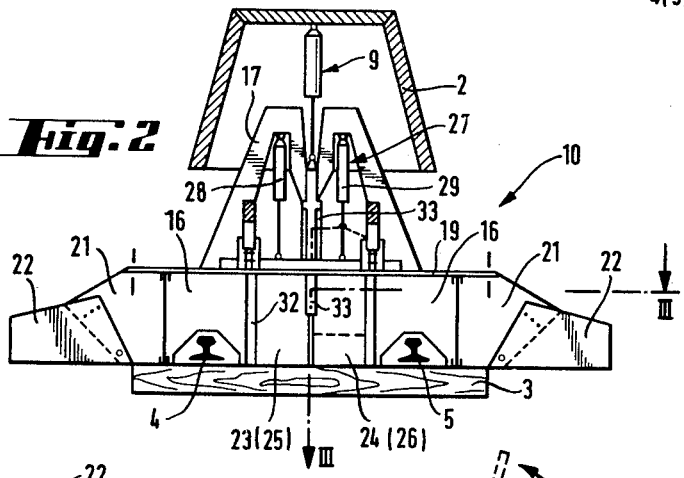
FIG. 2 is a front elevational view, partly in section along line II—II of FIG. 1, of the vertically adjustable ballast plow arrangement.
Figure 3:
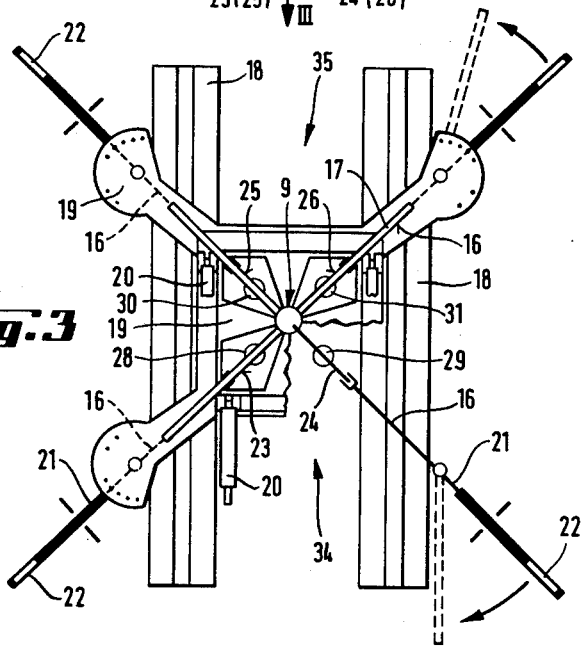
FIG. 3, is a top view of the ballast plow arrangement, partly in section along line III—III of FIG. 2.

A preferred embodiment of ballast plow arrangement 10 according to this invention is shown on a larger scale in FIGS. 2 and 3. In this preferred embodiment, the ballast plow arrangement is a unit comprised of a pair of generally V-shaped plows 34 and 35. Each plow includes a pair of plow blades 16 and a respective one of the plow blades is associated with each track rail 4, 5 and bridges over the associated track rail. Each plow further includes a ballast guide plate 23, 24 and 25, 26 associated with each plow blade 16 in the transversely extending space and adjustable in relation to the associated plow blade. Additional drive means 27 is provided for vertically adjusting the ballast guide plates in relation to the plow blades. In the preferred embodiment, the additional drive means comprises a separate drive 28, 29 and 30, 31 for independently vertically adjusting each ballast guide plate 23, 24 and 25, 26 and this additional drive means is mounted on generally V-shaped plow 34 and 35 of plow arrangement 10. The illustrated drives 28, 19 and 30, 31 are hydraulic motors, as is drive 9 for vertically adjusting the ballast plow arrangement.

This independent vertical adjustability of the ballast guide plates in relation to each other and to the associated plow blades makes a great variety of working positions possible and enables the ballast guide plates to be moved and pivoted in a plane above any local accumulation of ballast so that any required positional adjustments of the ballast guide plates may be effected rapidly where such accumulations occurs. Mounting the additional drive means on the plow makes the structure particularly simple and robust while permitting the entire plow arrangement to be vertically adjusted without difficulty.

It is important for the plow blades and guide plates to be adjusted in unison in relation to the ballast so that the ballast bed may be planed uniformly where desired.

In the illustrated embodiment, plow arrangement 10 further includes carrier frame 17 for the pair of plow blades 16 bridging the transversely extending space between the track rails, additional drive means 28, 29 and 30, 31 being mounted on the carrier frame. Four links 20 pivotally connect carrier frame 17 to machine frame 2.

Tunnel-shaped rail covering element 18 is connected to the underside of each plow blade 16 to straddle the associated track rail 4, 5 and, in the illustrated embodiment, each rail covering element 18 fixedly interconnects the plow blades of the two plows 34 and 35 associated with the same rail. Cover plate 19 is affixed to the upper edge of each plow blade 16.

Each plow blade 16 is equipped with plow wing 21 which is hinged to the plow blade for pivoting about a vertical axis into selected angular positions in relation to the plow blade. The plow wings may be fixed in the selected angular position by means of a bolt (not shown) engaging a selected hole in a segmental end portion of cover plate 19. For further shaping the ballast laterally adjacent the track, end plates 22 are mounted on the ends of plow wings 21 and the end plates may be pivotally adjusted in relation to the track plane.

In accordance with the illustrated preferred embodiment of the invention, each ballast guide plate 23, 24, 25, 26 is slidable in relation to associated plow blade 16 for vertical adjustment with respect thereto, the ballast guide plates and the associated plow blades having adjacent side edge. A vertical guide along one of the side edges receives the other side edge for vertical sliding adjustment of the ballast guide plate, the illustrated guide being a groove 32 in the side edge of plow blade 16 for receiving the side edge of the associated ballast guide plate. This arrangement provides great space economy since the upward sliding of the ballast guide plates will completely disengage them from the ballast and readily provide for any selected distribution of ballast by the plow.

As is clear from FIG. 3, each ballast guide plate and associated plow blade extend in a common plane to constitute one side of the generally V-shaped plow 34 and 35, adjacent vertical side edges of the ballast guide plates 23, 24, 25, 26 defining the apex of the V-shaped plow. Vertical guide 33 on carrier frame 17, which is vertically movable therewith, slidably guides the adjacent vertical side edges of the ballast guide plates during vertical adjustment thereof. In this manner, each ballast guide plate is firmly held in a vertical guide along both side edges thereof, thus preventing bending of the guide plates under torsional or other mechanical forces applied thereto by the plowed ballast. Furthermore, the vertical adjustment drives need no longer be arranged in the lower portion of the plow but may be applied to its upper portion, thus further saving space and preventing interference of the drives with the ballast plowing operation. The firmly guide ballast guide plates are vertically adjustable by hydraulic motors 28, 29, 30 and 31 which engage the upper edge of the guide plates substantially at a midpoint between their guided side edges.

Common control 36 is arranged on machine frame 2 for operating drive 9 for vertically adjusting plow arrangement 10 and additional drive means 27 for the ballast guide plates. Such a common control, which may be operated from a central control panel in an operator's cab on the machine frame, is particularly useful in operations requiring the use of all the plow components, except at the beginning and the end of the operation when practical considerations require the common control of all components for adjusting them so that the machine may be transported to another working site. While a manual operation of all the adjustments would be possible, it is advantageous for the operator to be able to control these adjustments centrally.

Furthermore, another control 37 is provided for independently operating each drive 28, 29, 30 and 31 of additional drive means 27. This enables the operator to adjust each ballast guide plate 23, 24, 25 and 26 individually, as shown in FIG. 2 in broken lines, for example, in connection with guide plate 24. This enables the operator to control the distribution of the ballast at each point of the operation by directing the flow of ballast in the desired directions and also by controlling the amount of the flowing ballast, as each guide plate is raised or lowered to a selected level. This individual adjustability of the ballast guide plates from control 37 provides for a fine tuning of the ballasting operation.

As shown in FIG. 3, plow arrangement unit 10 is comprised of a pair of generally V-shaped plows 34 and 35. Each ballast guide plate and associated plow blade extend in a common plane to constitute one side of each V-shaped plow and adjacent vertical side edges of the ballast guide plates define the apex of each V-shaped plow 34 and 35. The apices of the pair of plows meet at the center of the plow arrangement centrally between track rails 4 and 5 at a point of intersection of ballast guide plates 23, 24, 25 and 26. Thus, the plow arrangement is cross-shaped, tthe two V-shaped plows being mirror-symmetrically arranged with respect to each other. In other words, the ballast guide plates and their associated plow blades of the two plows form a cross, and vertical guide 33 slidably guides the vertical side edges of all the ballast guide plates at the center. In this manner, the entire plow arrangement unit 10 is vertically adjustable by hydraulic motor 9. This arrangement provides for a ready selection of a greater number of operating plow positions than available in known ballast plows.

As will appear from the following description of FIGS. 4 to 12, the plow arrangement permits a great variety of operational possibilities. The four centrally arranged ballast guide plates may be readily replaceable sheet metal elements whose individual adjustability enables the ballast to be distributed in a desired manner. Combining these adjustments with suitable adjustments of the pivotal plow wings, the following operation, among other, may be readily effectuated:

Filling the right or the left half of the track bed with ballast.

Removing ballast from the right or the left half of the track bed.

Distribution ballast from the center towards the sides or from the banks towards the center.

Distributing ballast from the right bank to the left or from the left bank to the right.

Plowing both banks towards the center.

These operations may be effected simply by suitably adjusting the vertical positions of selected ballast guide plates, the level of their vertical adjustment controlling the amount of redistributed ballast.

In FIGS. 4 to 12, the operating direction of the track working machine with plow arrangement 10 is indicated by arrow 38.

In the working position illustrated in FIG. 4, rear ballast guide plates 23 and 24 are lowered to engage the ballast while the front guide plates are raised. As shown by the small arrows, this causes the ballast to be plowed from the center of the track towards the two banks. In FIG. 5, the positioning of the guide plates is reversed, i.e. front ballast guide plates 24 and 25 are lowered into ballast engaging position so that the ballast is moved inwardly towards the center of the track from the sides thereof.

In the working position of FIG. 6, aligned ballast guide plates 24 and 25 are lowered while the two other guide plates are raised so that the ballast is moved from left to right, as shown by the small arrows. This is reversed in FIG. 7, ballast guide plates 23 and 26 being lowered to move the ballast from right to left.

In FIGS. 8 and 9, one of front guide plates 25 or 26 is lowered while the other guide plates are raised above the level of the ballast. Thus, either the right or the left half of the space between the track rails is filled with ballast. In FIGS. 10 and 11, either one of rear guide plates 24 or 23 is lowered so that ballast in removed either from the right or the left half of the space between the rails.

Finally, FIG. 12 shows all ballast guide plates raised in relation to plow blades 16. In this working position, the space between the track rails remains substantially unplowed while the banks of the track are plowed, excessive ballast from the banks being directed into the center space without being touched there by any of the plow components.

While the present invention has been described and illustrated in connection with a preferred embodiment, many modifications may occur to those skilled in the art without departing from the spirit and scope of this invention, as defined in the appended claims, particularly after benefitting from this teaching. Thus, while additional drive means 27 has been shown mounted on plow arrangement 10, it may be carried directly by machine frame 2. Also, while hydraulic motors are particularly useful as drive for the plow arrangement and the additional drive means for the ballast guide plates, other suitable power drives may be used.

The plow arrangement works not only in the operating direction indicated by arrow 8 or 38 but also in the reverse direction, in which case ballast sweeping device 13 and side plows 11 are raised into inoperative or rest positions.

The side plows are perferably conventional box plows enabling the plowed ballast to be conveyed in the direction of track elongation. Adjustment drives for pivotal wing plows 21 and 22 may also be operated from control 36. Furthermore, while ballast plow arrangement has been illustrated as being arranged on machine frame 2 between undercarriages 3, 3 and this positioning of the plow arrangement has been found very useful, it may also be mounted on a portion of the frame projecting from the front end of the machine frame, in which case it may be preferred to use a single generally V-shaped plow. Also, while mounting the ballast guide plates for vertical sliding is preferred, it is also possible to mount these plates for pivoting about axes extending in a plane substantially parallel to the track.

What is claimed is:

1. A track working machine for distributing and shaping the ballast of a railroad bed whereon two track rails are supported, the track rails defining a transversely extending space therebetween, which comprises (a) a frame, (b) a ballast plow arrangement vertically adjustably mounted on the frame, the plow arrangement including a generally V-shaped plow including (1) a pair of plow blades, a respective one of the plow blades associated with each track rail and bridging over the associated track rail, and (2) a ballast guide plate associated with each plow blade in the transversely extending space and adjustable in relation to the associated plow blade, (c) a drive for vertically adjusting the ballast plow arrangement in relation to the frame, and (d) additional drive means for vertically adjusting the ballast guide plates in relation to the plow blades.

2. The track working machine of claim 1, wherein the additional drive means comprises a separate drive for independently vertically adjusting each ballast guide plate.

3. The track working machine of claim 1 or 2, wherein the additional drive means is mounted on the generally V-shaped plow of the plow arrangement.

4. The track working machine of claim 3, wherein the plow arrangement further includes a carrier frame for the pair of plow blades bridging the transversely extending space, the additional drive means being mounted on the carrier frame.

5. The track working machine of claim 1 or 2, wherein each ballast guide plate is slidable in relation to the associated plow blade for vertical adjustment with respect thereto.

6. The track working machine of claim 5, wherein each ballast guide plate and the associated plow blade have adjacent side edges, and further comprising a vertical guide along one of the side edges and receiving the other side edge for vertical sliding adjustment of the ballast guide plate.

7. The track working machine of claim 1 or 2, wherein each ballast guide plate and associated plow blade extend in a common plane to constitute one side of the generally V-shaped plow, adjacent vertical side edges of the ballast guide plates defining the apex of the V-shaped plow.

8. The track working machine of claim 7, wherein the plow arrangement further includes a carrier frame for the pair of plow blades bridging the transversely extending space, and further comprising a vertical guide on the carrier frame for slidably guiding the adjacent vertical side edges of the ballast guide plates during vertical adjustment thereof.

9. The track working machine of claim 1, further comprising a common control arranged on the frame for operating the drive and the additional drive means together.

10. The track working machine of claim 2 or 9, further comprising a control for independently operating each drive of the additional drive means.

11. The track working machine of claim 1 or 2, wherein the plow arrangement is a unit comprised of a pair of the generally V-shaped plows, each ballast guide plate and associated plow blade extending in a common plane to constitute one side of each V-shaped plow, adjacent vertical side edges of the ballast guide plates defining the apex of each V-shaped plow and the apices of the pair of plows meeting at the center of the plow arrangement centrally between the track rails at a point of intersection of the ballast guide plates, the ballast guide plates and the associated plow blades of the two plows forming a cross, and further comprising a vertical guide for slidably guiding the vertical side edges of the ballast guide plates at said center.

* * * * *